United States Patent [19]

Ninehouser

[11] 4,378,611

[45] Apr. 5, 1983

[54] MULTIFUNCTION CLEANING AND DRYING DEVICE

[76] Inventor: James Ninehouser, 97681 Overseas Hwy., Key Largo, Fla. 33037

[21] Appl. No.: 390,906

[22] Filed: Jun. 22, 1982

[51] Int. Cl.[3] ..... A47L 7/00

[52] U.S. Cl. ..... 15/353; 169/14; 417/40

[58] Field of Search ..... 15/320, 321, 353; 169/14; 417/40

[56] References Cited

U.S. PATENT DOCUMENTS

| | | | |
|---|---|---|---|
| 2,822,061 | 2/1958 | Pettit | 15/321 X |
| 3,774,260 | 11/1973 | Emus | 15/321 |
| 3,775,053 | 11/1973 | Wisdom | 15/320 X |
| 3,931,662 | 1/1976 | Nayfa | 15/320 |
| 4,000,536 | 1/1977 | Nayfa | 15/320 X |
| 4,080,104 | 3/1978 | Brown | 15/353 X |

*Primary Examiner*—Billy J. Wilhite
*Attorney, Agent, or Firm*—Oltman and Flynn

[57] ABSTRACT

This device is an apparatus that may be used for many different functions or purposes. It includes vacuum cleaning; it can absorb dry or wet material and accumulate it. In the case of dry material, such may be accumulated dry in a container of any desired size for later disposal. In the case of wet material that is free flowing, it may be discharged through an outlet, connectable to a hose or pipe by having standard hose connections thereon. It is provided with a container for receiving and accumulating the collected material, and, if the material is liquid, it may be discharged from the container as desired. The container is provided adjacent its bottom with a normally open switch operable when the liquid level is below it to operate the suction pump to refill the container automatically, unless a manually operable switch in the circuit thereto has been operated to electrically disconnect the suction pump. A high pressure fluid pump is connected to the discharge pipe for operation when desired to discharge the liquid contents at high pressure, rather than letting it discharge at normal pressure when valves in the discharge pipe are suitably opened.

4 Claims, 4 Drawing Figures

MULTIFUNCTION CLEANING AND DRYING DEVICE

This application is a substitute of allowed application Ser. No. 06/152,987 filed May 27, 1980 by the present inventor and which was abandoned before the filing of this application.

OBJECTS OF THIS INVENTION

It is an object of this invention to provide an apparatus that can perform the functions of a number of different devices, including a vacuum cleaner, a wet or dry suction device leading into a container, that can accumulate liquid in the container for either storing it or for discharging it as desired, either at no pressure or at high pressure when desired, that may be used for defrosting refrigerators, for suctioning off melted frost in a refrigerator, spraying warm water on the coils with a high pressure pump, or outside source of water or chemical that may be used for cleaning air conditioning units, for cleaning carpets and many other obvious uses too numerous to enumerate.

A further object of this invention is to provide a device usable for applying cleaning fluid where desired; also may be used for spraying liquid where desired. It may be used for discharging fire extinguishing solutions at high pressure from a low pressure water source.

BRIEF DESCRIPTION OF THE FIGURES

With the foregoing and other objects as will hereinafter become apparent, this invention comprises the combinations, constructions and arrangements of parts, hereinafter set forth, claimed and disclosed in the accompanying drawings, in which:

DETAILED DESCRIPTION OF THE INVENTION

Figure 1:
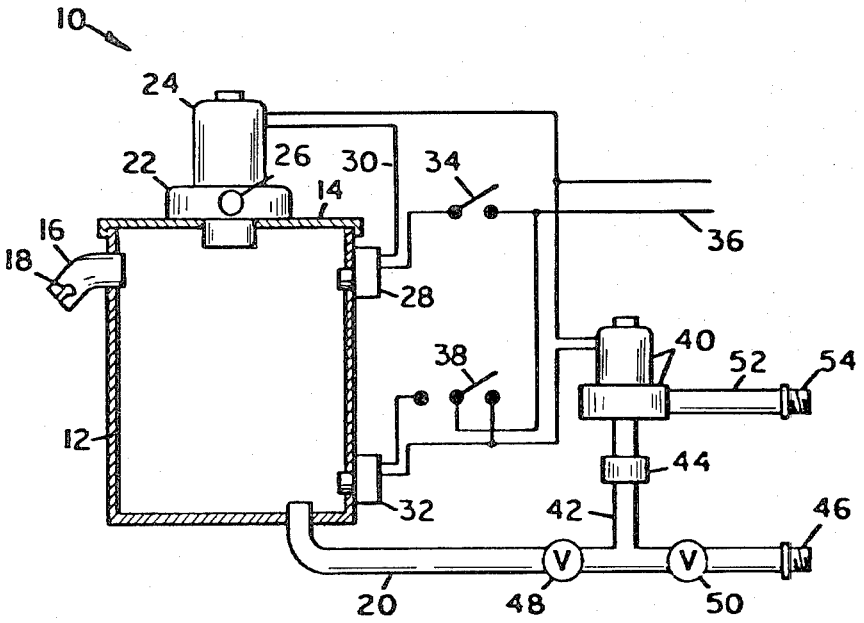
FIG. 1 is a diagrammatic view of the invention, both the switches being open and interrupting the flow of electricity.

There is shown at 10 the multi-function apparatus of this invention. This apparatus includes a container or tank 12 of any desired size having a closure cover 14. An inlet pipe 16 extends through the side of the container adjacent the top closure cover 14. This inlet pipe 16 is provided at 18 with a bayonet slot vacuum hose connection so that a flexible vacuum hose may be attached thereto as desired. At the bottom of the tank or container 14 is a discharge pipe 20.

Extending through the top cover 14 is a wet or dry suction pump 22 having a motor 24, and the suction pump 22 is provided with an air exhaust vent 20. Extending through the side of the tank 12 adjacent the top is an upper high level control switch 28 that is normally closed, but open when fluid reaches its height to open the circuit thereto, there being a circuit line 30 connecting it to vacuum 24 to stop the vacuum motor 24 when the fluid in the container reaches the upper fluid level switch 28.

A low fluid level switch 32 extends into tank 12 near its bottom and is normally open when the fluid level is above it but which closes if the fluid level drops below it.

Figure 4:
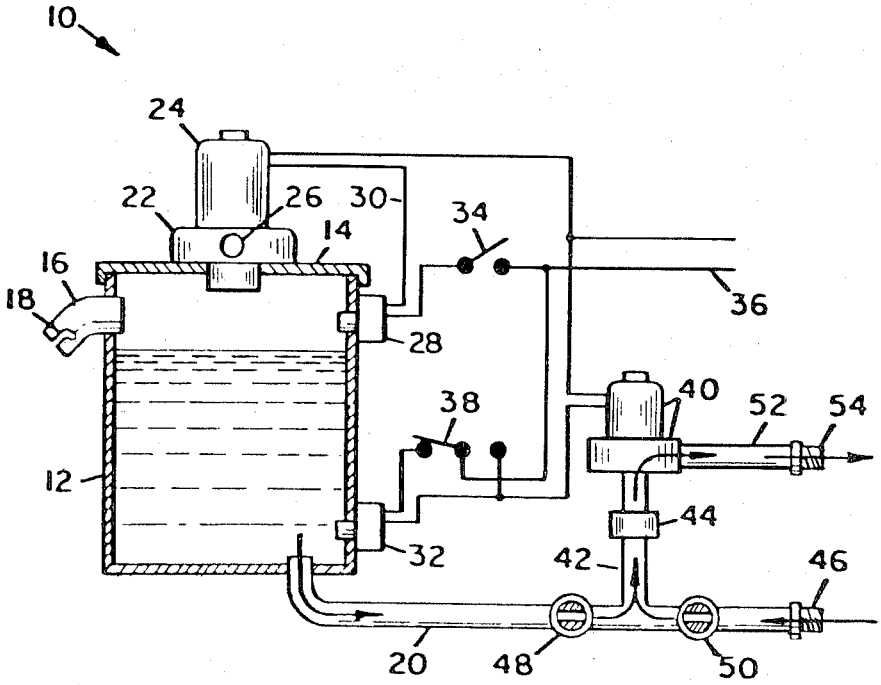
FIG. 4 shows the container being emptied and simultaneously mixed with fluid from an outside source.

A single pole single throw switch 34 is located in the power source line 36 through the upper fluid level switch 28 to the suction pump motor 24, this switch 34 making it possible to cut off the power line 36 to the suction pump motor 24 if and when desired. A single pole double throw switch 38 connects the power line 36 to the low fluid level switch 32 for operating the high pressure pump motor 40, as shown in FIG. 4, and when the single pole single throw switch 38 is open to deactivate exhaust pump motor 24, it completes the circuit to high pressure pump 40 to drain the tank 12.

The exhaust or drain pipe 20 is connected to the high pressure pump 40 by a T-joint pipe 42 having a strainer 44 therein to prevent any solid material from reaching the pump 40. The T-joint pipe 42 also connects to an inlet pipe 46 having a standard thread hose connection 46, and the T-joint pipe also has manually controllable valves 48 and 50, one on each side of the T-joint stem 42. These valves may be set to drain the tank 12 through the connection 46, or through the pump 40. Valve 50 may have its connection 46 connected to a fluid supply, as in FIG. 4, and thus add fluid to the fluid draining from tank 12, both then feeding through T-joint pipe stem 42 into the high pressure pump 40, as for example, when it is desired to have fire extinguishing chemicals or liquids in the tank 12 added to a supply of water entering through connection 46 and open valve 50, and both fluids are fed to high pressure pump to the pipe 52 and to a hose connected to standard pipe connection 54 and thus to a fire hose to extinguish a fire.

Figure 2:
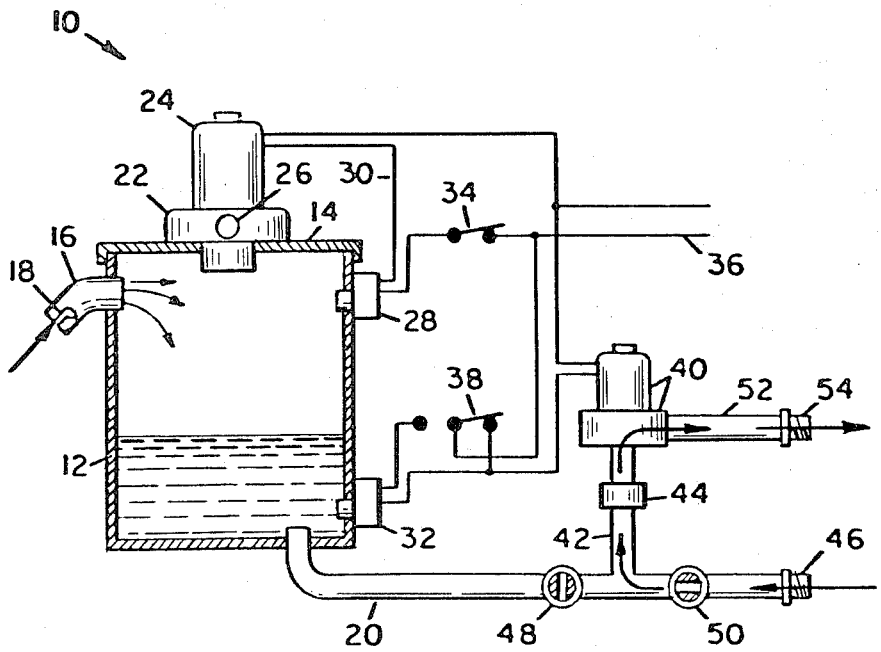
FIG. 2 is a similar diagrammatic view, both switches being closed to the intake vacuum motor and to the high pressure discharge motor, taking fluid from an outside source.

As shown in FIG. 2, fluid may enter tank 12 until it reaches high level switch 28 to then cut off the motor 24 of vacuum pump 22. Switch 38 connects the power circuit to pump 40, with the valve 48 closed from the tank 12 and the valve 50 open, as in FIG. 2, to accept liquid from a hose connected at 46 and feed it to high pressure pump 40.

Figure 3:
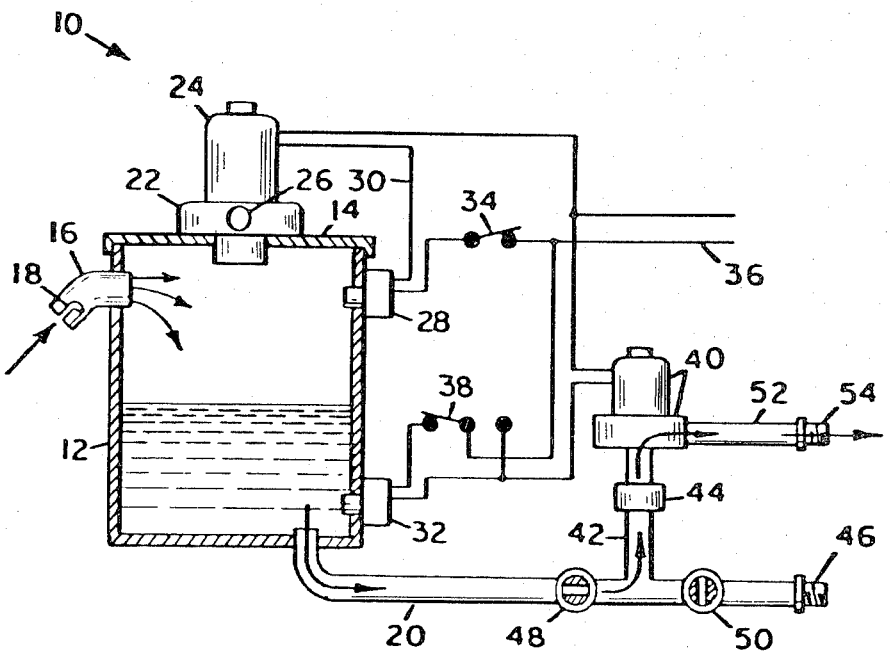
FIG. 3 shows fluid being sucked into the container and simultaneously mixed with fluid from an outside source.

In FIG. 3, fluid from the tank 12 passes through open valve 48 to T-joint pipe stem 42 and high pressure pump 40 to the pipe connection 54, valve 50 having been closed. Switch 34 is set to operate exhaust pump motor 24 and switch 38 is actuating high pressure pump 40, with valve 48 open and valve 50 closed, so that fluid from tank 12 exhaust through connection 54, as shown.

In FIG. 4, switch 34 interrupts the circuit to exhaust pump motor 24 and switch 38 connects the power to high pressure pump 40, valves 48 feeding liquid from the tank 12 through T-joint pipe stem 42 to the high pressure pump 40, and valve 50 is opened to feed liquid from its pipe connection 46 to high pressure pump 40 and its hose connection 54 to a standard hose connected thereto.

Many other set-ups may be used for many different purposes, too numerous to enumerate, some typical connections being shown already.

This invention may be used to defrost a refrigerator, taking in hot water from connections 46 over the frost to melt it, and connecting the melted frost to the tank through pipe 16.

In FIG. 2, it may be used for defrosting refrigerator units suctioning off melted frost while spraying warm water in the refrigerator coils with the high pressure pump 40. It may be used for cleaning air conditioner units, for cleaning and vacuuming carpets, etc.

With the set up as shown in FIG. 3, it may be used for applying cleaning fluid, for spraying liquid fertilizer where desired, for discharging cannister fluids, etc.

In FIG. 4, it may be used for mixing liquid chemicals in the tank 12 with water and discharging or spraying the mixture where desired. It may also be used for mixing and discharging solutions at high pressure from low pressure water source from connection 46.

Also, this invention may be used for mixing and discharging fire extinguishing solutions at high pressure from a low pressure water source.

These are but a few of the many possible uses of this apparatus, and many more uses will be obvious as desired.

Although this invention has been described in considerable detail, such is intended as being illustrative rather than limiting, since the invention may be variously embodied, and the scope of the invention is to be determined as claimed.

Having thus set forth and disclosed the nature of this invention, what is claimed is:

1. A multi-function cleaning and drying apparatus 10 comprising a liquid container 12 having a closed cover 14 thereon, an air suction pump 22 and motor 24 mounted on and through said cover, said pump 22 having an air exhaust vent 26 therein extending externally of said container, a suction inlet pipe 16 having a vacuum hose connection 18 thereon, a drain pipe 20 connected to the bottom of said container 12, said bottom drain pipe 20 having a standard hose 46 connection thereon providing a liquid inlet, a pair of spaced-apart valves 48 and 50 in said bottom pipe 20, an outlet T-pipe 42 connected to said liquid inlet between its said spaced-apart valves, said outlet connecting T-pipe having a strainer 44 in its T-stem, a standard hose connection 54 at the end of said outlet T-pipe 42, a liquid high pressure pump and motor connected to said outlet by a pipe, a power circuit 30 connecting to both said pump motor 24 on its said cover 14 and to said high pressure pump motor 40, said circuit having a normally closed upper fluid level switch 28 extending into said container 14 at its normally high fluid level, said circuit having normally open low fluid level switch 32, adjacent the bottom of said container closed when in use but open when the fluid level is below it and connected to shut off said high pressure pump motor 40 when the liquid level is therebelow.

2. The apparatus of claim 1, and a manually operable cut-off switch 34 in the circuit 30 from a power source 36 to said air suction pump motor 24.

3. The apparatus of claim 1, and a manually operable double pole double throw switch in the circuit to said high pressure pump motor 40 and to said low level switch 32 to selectively operate said high pressure pump motor 40 either with or without said low level switch 32.

4. The apparatus of claim 3, and a manually operable shut-off switch 34 in the circuit 30 from a power source 36 to said air suction pump motor 24.

* * * * *